US010757965B2

(12) United States Patent
Prestia et al.

(10) Patent No.: US 10,757,965 B2
(45) Date of Patent: Sep. 1, 2020

(54) FEEDER FOR COMPONENTS OF AN AEROSOL FORMING ARTICLE

(71) Applicant: PHILIP MORRIS PRODUCTS S.A., Neuchatel (CH)

(72) Inventors: Ivan Prestia, Longara di Calderara di Reno (IT); Cristian Costarelli, Neuchatel (CH)

(73) Assignee: Philip Morris Products S.A., Neuchatel (CH)

( * ) Notice: Subject to any disclaimer, the term of this patent is extended or adjusted under 35 U.S.C. 154(b) by 246 days.

(21) Appl. No.: 16/063,471

(22) PCT Filed: Dec. 30, 2016

(86) PCT No.: PCT/EP2016/082941
§ 371 (c)(1),
(2) Date: Jun. 18, 2018

(87) PCT Pub. No.: WO2017/114959
PCT Pub. Date: Jul. 6, 2017

(65) Prior Publication Data

US 2019/0000132 A1 Jan. 3, 2019

(30) Foreign Application Priority Data

Dec. 30, 2015 (EP) ..... 15203203

(51) Int. Cl.
*B65G 47/56* (2006.01)
*A24C 5/32* (2006.01)
(Continued)

(52) U.S. Cl.
CPC ..... *A24C 5/325* (2013.01); *A24C 1/26* (2013.01); *A24C 5/327* (2013.01); *A24C 5/478* (2013.01); *A24D 3/0287* (2013.01); *A24F 47/008* (2013.01)

(58) Field of Classification Search
CPC ..... B65G 47/56
(Continued)

(56) References Cited

U.S. PATENT DOCUMENTS 1,856,688 A * 5/1932 Behrlenz ..... A24C 5/392 131/109.1
3,253,491 A * 5/1966 Rakowicz ..... A24D 3/0254 83/411.6
(Continued)

FOREIGN PATENT DOCUMENTS

WO WO 2003/024898 3/2003
WO WO 2013/076750 5/2013

OTHER PUBLICATIONS

PCT Search Report and Written Opinion for PCT/EP2016/082941 dated Mar. 31, 2017 (11 pages).

*Primary Examiner* — Douglas A Hess
(74) *Attorney, Agent, or Firm* — Mueting Raasch Group

(57) ABSTRACT

The present invention refers to a feeder for components of an aerosol-forming article, the feeder comprising: —a plurality of tubular hoppers, each hopper being adapted to receive and to deliver a plurality of components, each hopper including an inlet and an outlet and a channel connecting the inlet and the outlet, each channel having an axis and defining an insert dimension in a direction perpendicular to the axis, the insert dimension being constant along the axis of the channel; —a frame to which the tubular hoppers are fastened and arranged so that their axes are substantially parallel to each other and in series along a transport direction; —a delivery drum including a plurality of angularly spaced grooves arranged substantially parallel to said transport direction, said drum being located under the outlets of the tubular hoppers so that components going through said channels are delivered into one of said groves; —a motor to rotate said delivery drum; —a transport device
(Continued)

located under said delivery drum and adapted to transport said components delivered by the delivery drum along the transport direction; and —a size change element adapted to vary the insert dimension of the channel of at least one of the plurality of hoppers.

20 Claims, 5 Drawing Sheets

(51) Int. Cl.

| | |
|---|---|
| ***A24D 3/02*** | (2006.01) |
| ***A24C 1/26*** | (2006.01) |
| ***A24C 5/47*** | (2006.01) |
| *A24F 47/00* | (2020.01) |

(58) Field of Classification Search
USPC ..... 198/397.01, 397.02, 418.2, 450, 475.1; 131/57.5
See application file for complete search history.

(56) References Cited

U.S. PATENT DOCUMENTS

| | | | | |
|---|---|---|---|---|
| 4,296,660 | A | 10/1981 | Athos | |
| 5,531,312 | A * | 7/1996 | Dickey | B65G 47/1485 198/450 |
| 5,575,377 | A * | 11/1996 | Etani | B65B 19/04 198/478.1 |
| 5,695,441 | A | 12/1997 | Takayuki | |
| 6,059,518 | A * | 5/2000 | Hamilton | B23P 19/002 198/397.03 |
| 6,092,642 | A * | 7/2000 | Boldrini | B65B 19/105 198/418.2 |
| 6,311,831 | B1 * | 11/2001 | van der Griendt | B65G 21/2036 198/377.08 |
| 6,435,334 | B1 * | 8/2002 | Spatafora | B65B 19/04 131/282 |
| 7,674,218 | B2 * | 3/2010 | Evans | A24D 3/0254 493/39 |
| 9,199,748 | B2 * | 12/2015 | Cremer | B65B 43/60 |
| 10,609,952 | B2 * | 4/2020 | Fallon | A24C 5/47 |

* cited by examiner

FEEDER FOR COMPONENTS OF AN AEROSOL FORMING ARTICLE

This application is a U.S. National Stage Application of International Application No. PCT/EP2016/082941 filed Dec. 30, 2016, which was published in English on Jul. 6, 2017, as International Publication No. WO 2017/114959 A1. International Application No. PCT/EP2016/082941 claims priority to European Application No. 15203203.3 filed Dec. 30, 2015.

The present invention relates to a feeder for components of an aerosol forming article and preferably to be used in an apparatus for manufacturing multi-component aerosol forming articles.

Typically, an aerosol forming article comprises a plurality of components assembled in the form of a rod. These components may include a combustible heat source, an aerosol forming substrate, which may be located within, around or downstream the combustible heat source, and a mouthpiece filter, located downstream of the aerosol forming substrate within the rod.

The aerosol forming substrate in an aerosol forming article is typically a processed substrate that contains an aerosol former such as glycerin. For example, the aerosol forming substrate included in an aerosol forming article may comprise a crimped or folded tobacco plug comprised of cast leaf or reconstituted tobacco. A flavor, such as menthol, may be loaded into the aerosol forming substrate. Alternatively, a flavor-forming component is added to the aerosol forming article to provide a flavor.

The provision of flavor, in the form of menthol capsules, heat sources and of additional elements, such as metal parts, requires the manufactures of multi-components aerosol-smoking articles.

Multi-component aerosol forming articles are known to be manufactured in a serial process in which each aerosol forming article is formed by serially juxtaposing all its components along a longitudinal axis defined by the aerosol forming article. At the end of the manufacturing process, a quality check takes place, during which the aerosol forming articles which do not comply with the required specifications are removed and discarded.

In an apparatus for the formation of the multi-component aerosol forming article, each component might be delivered by a different feeder.

The various components forming the aerosol forming article often have different length and therefore each feeder of a different component of the multi-component aerosol-forming article should be adapted and built according to the dimensions of the specific component to be delivered. Further, when changing from a production of a first aerosol-generating article, to a second—different—one, the components included in the second article may have different dimensions than those of the first article, and thus a change of the feeder might be needed. Production delays are therefore possible.

As such, it is an object of the present invention to provide a feeder for components and an apparatus for the manufacturing of multi-component aerosol forming articles that may increase the efficiency of manufacturing the multi-component aerosol forming articles.

The present invention relates to a feeder for components of an aerosol-forming device, the feeder comprising a plurality of tubular hoppers, each hopper being adapted to receive and to deliver a plurality of components, each hopper including an inlet and an outlet and a channel connecting the inlet and the outlet, each channel having an axis and defining an insert dimension in a direction perpendicular to the axis, the insert dimension being constant along the axis of the channel; a frame to which the tubular hoppers are fastened and arranged so that their axes are substantially parallel to each other and in series along a transport direction; a delivery drum including a plurality of angularly spaced grooves arranged substantially parallel to said transport direction, said drum being located under the outlets of the tubular hoppers so that components going through said channels are delivered into one of said grooves; a motor to rotate said delivery drum; a transport device located under said delivery drum and adapted to transport said components delivered by the delivery drum along the transport direction; and a size change element adapted to vary the insert dimension of the channel of at least one of the plurality of hoppers.

Components for aerosol-forming articles generally defines a longitudinal axis. These components are preferably inserted in the feeder which delivers them to a transport device which transport the components to for example a filter forming unit to form filters, preferably multi-component filters, for aerosol-forming articles. In the feeder of the invention, hoppers having a specifically designed layout are employed, which allow the flow of components through them minimizing the risks of rotation of the same. The components are flowing within channels, a channel for each hopper. The channels have a dimension along a direction perpendicular to a channel axis, called insert dimension, which is kept constant along the whole length of the channel. Preferably, this selected insert dimension is such that a single component can be introduced in an inlet of the hopper and can flow through the channel. For example, advantageously, the components are inserted in the hoppers with their longitudinal axis parallel to the insert dimension. Due to this insert dimension which is properly selected and is kept constant along the channel, the inserted component cannot rotate inside the channel and therefore it is always correctly delivered onto the delivery drum without misplacements, avoiding machine interruptions. Further, this insert dimension can be changed thanks to the provision of a size change element. The size change element may increase or decrease the size of the insert dimension of the channel which is kept constant along the length of the channel itself, so that components having a different length, that is, a different dimension along their longitudinal axis, can be fed using the same feeder, without change of parts or machine interruption, increasing the productivity.

In the following, with the term "components" any element which may be included in an aerosol forming article is meant. Such elements are known in the art and not further detailed below. For example, such component might include a plug of a filter, a heat source, a menthol capsule, a charcoal element, and so on.

Each component defines longitudinal axis. Generally, but not necessarily, the components might be rod shaped.

In the following, the term "rod" denotes a generally cylindrical element of substantially cylindrical, oval or elliptical cross-section, comprising two or more components of an aerosol forming article.

Aerosol forming articles according to the present invention may be in the form of filter cigarettes or other smoking articles in which tobacco material is combusted to form smoke. The present invention additionally encompasses articles in which tobacco material is heated to form an aerosol, rather than combusted, and articles in which a nicotine-containing aerosol is generated from a tobacco material, tobacco extract, or other nicotine source, without combustion or heating. These articles in which aerosol is formed without combustion or where smoke is produced by combustion are in general called "aerosol-forming articles". Aerosol forming articles according to the invention may be whole, assembled aerosol forming articles or components of aerosol forming articles that are combined with one or more other components in order to provide an assembled article for producing an aerosol, such as for example, the consumable part of a heated smoking device or filters.

As used herein, aerosol forming article is any article that generates an inhalable aerosol when an aerosol forming substrate is heated. The term includes articles that comprise an aerosol forming substrate that is heated by and external heat source, such as an electric heating element. An aerosol forming article may be a non-combustible aerosol forming article, which is an article that releases volatile compounds without the combustion of the aerosol-forming substrate. An aerosol forming article may be a heated aerosol forming article, which is an aerosol forming article comprising an aerosol forming substrate that is intended to be heated rather than combusted in order to release volatile compounds that can form an aerosol. The term includes articles that comprise an aerosol forming substrate and an integral heat source, for example a combustible heat source.

An aerosol forming article may be an article that generates an aerosol that is directly inhalable into a user's lungs through the user's mouth. An aerosol forming article may resemble a conventional smoking article, such as a cigarette and may comprise tobacco. An aerosol forming article may be disposable. An aerosol forming article may alternatively be partially-reusable and comprise a replenishable or replaceable aerosol forming substrate.

An aerosol forming article may also include a combustible cigarette.

In preferred embodiments the aerosol forming article may be substantially cylindrical in shape. The aerosol forming article may be substantially elongated. The aerosol forming-article may have a length and a circumference substantially perpendicular to the length. The aerosol forming article may have a total length between approximately about 30 millimeters and approximately 100 millimeters. The aerosol forming article may have an external diameter between approximately about 5 millimeters and approximately about 12 millimeters.

According to the invention, the feeder delivers at least two components per time—unit due to the fact that it includes at least two hoppers mounted on the same base. Preferably, many hoppers are mounted on the same base, preferably between 4 and 100 hoppers, more preferably between 20 and 80 hoppers. All hoppers define an internal channel having an inlet, from where the component are introduced, and an outlet, from where the components are delivered into a delivery drum. The hoppers are located in series and therefore the components delivered from the plurality of outlets are delivered in series, that is, one after the other substantially along the same direction. Preferably, each hopper delivers a single component per time unit, that is, in a single hopper a column of components is formed and in each row of the column a single component is present. Already the provision of a plurality of hoppers allows forming a multi-component article, for example feeding a different component in each different hopper of the plurality.

Each channel defines an axis, that may coincide with the direction of major extension of the channel. If the channel is symmetric, preferably its axis is also, but not necessarily, a symmetry axis. The axis may be vertical.

The hopper may have the form of a hollow tube. Preferably, hoppers are made—at least partially—of metal.

A cross section of the hopper, cross section realized along a plane perpendicular to the axis of the channel, defines a geometrical closed form which defines at least two orthogonal directions. One of the dimensions of the closed geometrical form along one of the two orthogonal directions is considered to be the insert dimension, which is preferably the dimension which is relevant for the insertion of components. This dimension is preferably chosen so that components can be inserted inside the channels, that is, for example it may not be smaller than all dimensions in all directions of the components to be introduced in the hopper. Components are preferably inserted perpendicularly to their longitudinal axis, that is, the longitudinal axis of the component is substantially perpendicular to the axis of the channel, so that the component falls in a direction perpendicular to its longitudinal axis. This insert dimension is kept constant along the whole length of the channel, that is, along the axis of the channel. Therefore, if a component can be introduced into the inlet, having a given insert dimension, at least this insert dimension is maintained constant along the whole channel of the tubular hopper and thus the component can flow through the channel to the outlet of the same. The dimension of the channel along its axis is called the length of the channel.

Preferably, the whole cross section of the channel is maintained constant along the whole length of the channel. Therefore, the components inserted therein, preferably with their longitudinal axis perpendicular to the axis of the channel, once inserted, if the dimensions of the cross section are properly chosen, cannot rotate from the insertion position. Therefore, when the component is inserted perpendicularly to its longitudinal axis, it also exits the hopper perpendicularly to the longitudinal axis.

The hoppers are arranged in series one after the other and attached to the same frame. Preferably, the distance between adjacent hoppers, that is, the distance between two outlets of two subsequent channels arranged next to each other, is preferably smaller than about 20 millimeters, more preferably smaller than about 10 millimeters, even more preferably comprised between about 5 millimeters and about 7 millimeters. Preferably, this distance is kept as small as possible in order to have the components delivered by the different hoppers arranged as close as possible to each other. However, the size of the walls of each hopper generally may prevent a direct contact between the components. Preferably, all channels have their axes parallel to each other. Each insert dimension of each channel defines an insert direction and preferably all insert directions are parallel to each other, more preferably they are forming a single insertion line, that is, when the hoppers are mounted on the frame, the channels are so arranged that the insert dimensions are all positioned along the same line, called insertion line. In this way, when different components are inserted in different hoppers, also all the longitudinal axes of the different components are aligned and all the components in the different hoppers fall substantially along a line.

Preferably, the insert dimension is longer than the longitudinal axis of the component when the component is inserted in the channel of the hopper. In order to be properly inserted, for example the insert dimension is at least about 0.5 millimeters longer than the longitudinal dimension of the component. More preferably, it is about 1 millimeter longer. In this way, the components can be easily introduced in the channel without friction with their longitudinal axis aligned with the insert dimension. Preferably, the components are rod shaped and the longitudinal axis is the axis of the rod.

The insert dimension can be changed depending on the size of the components, preferably depending on their length along the longitudinal axis. A size change element is located in at least a hopper so that the insert dimension can be varied inside the channel. The change in size of the insert dimension is preferably uniform along the whole channel, that is, the channel has always an insert dimension which is constant along the length of the channel, but the value of the insert dimension can be varied. Therefore, preferably, the insert dimension can be increased or decreased, on the basis of the dimension of the components to be delivered.

The components flow through the channels of the hoppers and are delivered through the outlets on a delivery drum. The delivery drum includes a plurality of grooves, preferably angularly spaced, which are adapted to receive the components when discharged from the hoppers. Preferably, each grove hosts a component. Preferably, a longitudinal length of the groove is such that it extends under all outlets of all the plurality of channels. The groove has a longitudinal length along the same direction as the insertion line. Therefore groove and insertion line are parallel to each other and the drum, and thus the groove, is located under the insertion line. The drum therefore can receive all components delivered from all hoppers of the feeder.

The drum can rotate, for example my means of a motor, such as an electric motor, so that the components which have been delivered on the groove located under the outlets can be in turn delivered on a transport device which is positioned substantially parallel to the groove and under the drum, so that after a rotation—for example of 180°—of the drum, the components fall from the groove to the transport device. The motor of the drum is preferably driven using a Geneva drive or Maltese cross gear mechanism. This gear mechanism translates a continuous rotation into an intermittent rotary motion. The rotating drive wheel connected to the motor has preferably a pin that reaches into a slot of the driven wheel advancing it by one step. In this way, at every "step" of the intermittent rotary motion, the drum in which the components are located is "shacked" and the components can easily fall off onto the transport device without remaining attached to the groove, as it might happen at a high speed drum rotation.

The transport device is then adapted to transport the fallen components to other parts of an apparatus to form aerosol-forming articles. The transport device transports the components along a transport direction which is parallel to the groove and preferably also parallel to the insert line.

Preferably, each hopper of said plurality is releasably fastened to said frame. The possibility of fastening and unfastening the hoppers from the frame allows an easier re-filling of each hopper with components.

Preferably, said hoppers are arranged so that the axes of the channels are substantially parallel to a vertical direction so that components inserted into the channel via the inlet fall toward the outlet due to gravity. It is preferred that the functioning of the feeder is as simple as possible, that is, that the number of mechanical parts is limited. For this reason, it is preferred that the flow of the components within the channels of the hoppers takes place due to gravity only, without the aid of any mechanical system which may push the components towards the outlets.

Preferably, the insert dimension defines the major dimension of said inlet or of said outlet. A cross section of the channel defines a closed curve, which might be a rectangle or an oval shape. In any geometry, a major dimension (or an infinite number of major dimensions, such as in a circumference) can be defined, which is the longest segment connecting two points of the closed curve. Further, a dimension of the cross section is called "an insert major dimension" only if insertion of a component with the axis of the component oriented along the major dimension is possible. For example, in case of a rectangular cross section of the channel, the diagonal of the rectangle is the overall geometrical major dimension, however the insertion of a component might not be possible along the diagonal due to the restriction in dimensions at the corners of the rectangle. In this case—if the insertion is possible along the major side of the rectangle—the major side of the rectangle becomes the insert major dimension.

Preferably, the insert dimension is smaller than twice a major longitudinal dimension of said component inserted in said hopper. If the insert dimension is substantially smaller than 2× the major longitudinal dimension of the component, that is, the dimension of the component along its longitudinal axis, rotations of the component inside the channel may be prevented. The other dimensions of the channel cross section may not allow a different positioning of the component while flowing in the channel. Further, an insertion of only a single component per time unit is allowed in the channel.

Preferably, the insert dimension is a dimension of said channel along the transport direction. The components are preferably transported in series with their longitudinal axes one after the other (that is, with aligned longitudinal axes along the same line). Therefore, preferably the insert direction is the direction along which the components fall into the drum located below the hoppers. In an alternative embodiment, the components are aligned with their axis parallel to each other, but not in series. The components flow in the channels so that their longitudinal axis are parallel to each other and perpendicular to the direction of flow. The components are then deposited on a transport device with their longitudinal axis perpendicularly to the direction of transport. The insert dimension is in this case perpendicular to the direction of transport.

Preferably, the channel has a constant cross section along planes perpendicular to its axis. Advantageously, not only the insert dimension is kept constant along the channel, but the whole cross section of the channel is kept constant along the length of the channel. In this way, the rotation of the components inside the channels may be minimized.

More preferably, a size of the cross section is such that the insertion of a single component is possible, so that the channel is adapted to house a single column of components. The components in the channel are preferably stacked along the vertical direction one on top of the other. Due to the inlet and outlet dimensions, a single column of components can be present in each hopper. This may improve the alignment of the components and their subsequent delivery in the groove of the drum.

Preferably, the feeder includes a suction device and wherein said transport device includes a plurality of holes, said suction device being adapted to suck air from said holes so as to keep the components connected to the transport device. In order to keep the components, which are generally light-weight and of rod-like shape, in place on the transport device while the latter is moving to transport the components during the manufacturing process of the aerosol-forming articles, the transport device itself is connected to a suction unit which, by means of holes in the transport device, uses vacuum and a suction effect so that the components are sucked against the transport device surface where they may remain stably fixed.

Preferably, the feeder includes one or more curvilinear walls contouring without contact at least a portion of a lateral surface of the delivery drum. In the rotation of the delivery drum transporting the components from the outlets of the hoppers to the transport device, the components may fall off the groove where they are positioned. In order to avoid the loss of components, curvilinear walls are preferably contouring the drum, preferably along a portion of its lateral surfaces, so that the presence of the walls minimizes the risk of drop of components during drum's rotation. The walls defines at least preferably two openings, one opening located below the hoppers so that the components can fall from the hoppers to the drum, and one opening located above the transport device to allow the components to fall from the drum to the transport device.

Preferably, each hopper of the plurality includes a size change element. Advantageously, each hopper has a size change element so that the insert dimension of each hopper can be adjustable and the flexibility of components introduction in the feeder is further enhanced. Thus, size change elements also form a plurality of size change elements, due to the fact that there is a size change element for each hopper of the plurality.

More preferably, the each size change element of the plurality of size change elements is independently adjustable. The size of an insert dimension of a hopper is independently regulated from the size of an insert dimension of another hopper of the feeder. Each hopper of the feeder can therefore house components which may have a variable dimension from one batch to the following one. Moreover, different components having different lengths can be housed and delivered at the same time in the same feeder.

Preferably, the feeder includes a handle. Preferably the handle is connected to the frame so that the whole feeder can be easily transported.

Preferably, the feeder includes a cover for the outlet of at least one hopper when the hopper is detached from the frame. The hoppers are preferably detachable from the frame, for example in order to be filled with components to be delivered. In order not to lose components while transporting the hopper, it is preferred that the outlet of the hopper can be closed by a removable cover.

Preferably, the size change element includes a slidable wall which is adapted to be slidable along a direction defined by said insert dimension. The insertion dimension can be varied inside the channel. In a simple realization, which does not require a complex mechanism, the size of the insert dimension can be varied "moving" a wall of the channel, that is, one of the inner walls defining the inner surface of the channel may be slidable along a direction defined by the insert dimension and therefore changing the position of the wall may change the size of the insertion dimension.

Preferably, the slidable wall is moved by means of a screw. A screw mechanism may change a rotation motion, the one of the screw, into a translation motion, needed to slide the wall of the size change element. In this way, the insertion dimension can be easily varied screwing or unscrewing a screw present in each hopper.

The invention also relates to an apparatus for the realization of a multi-component aerosol-forming article, comprising one or more feeder realized according to the previous aspect. The feeder is preferably used in an apparatus to form multi-component aerosol-forming articles, or part thereof, such as multi-component filters. Therefore, preferably the feeder of the invention is used in combination with additional feeders which may deliver different type of components. The additional feeders can be realized according to the invention or according to known solutions.

Preferably, the apparatus comprises a first feeder and a second feeder, the second feeder being apt to feed components to the same transport device as the first feeder. The feeders deliver the components on the same transport device, so that the components of different types can be alternatively positioned one after the other to create multi-component aerosol-forming articles.

Preferably, the apparatus further comprises a spacer drum located downstream said feeder. A spacer drum, generally known in the art, is used in order to reduce a gap which might be present between two consecutive components transported in the transport device. The components, as mentioned, fall into the transport device from the hoppers. A small distance can be present between two adjacent components due to the distance between the hoppers' outlets. In order to reduce or avoid any gap, the spacer drum is used, so that the multi-components article is properly formed without voids.

Preferably, the apparatus comprises a wrapping station so as to wrap the components fed by said feeder. The wrapping station is adapted to wrap the components fed by the feeder(s) so that an aerosol-forming article can be realized. More preferably, after the wrapping station, also a cutting unit is positioned, so that the long continuous flow of wrapped components attached one to the other is cut in single aerosol-forming articles.

The invention will be further described, by way of example only, with reference to the accompanying drawings in which.

Figure 1:
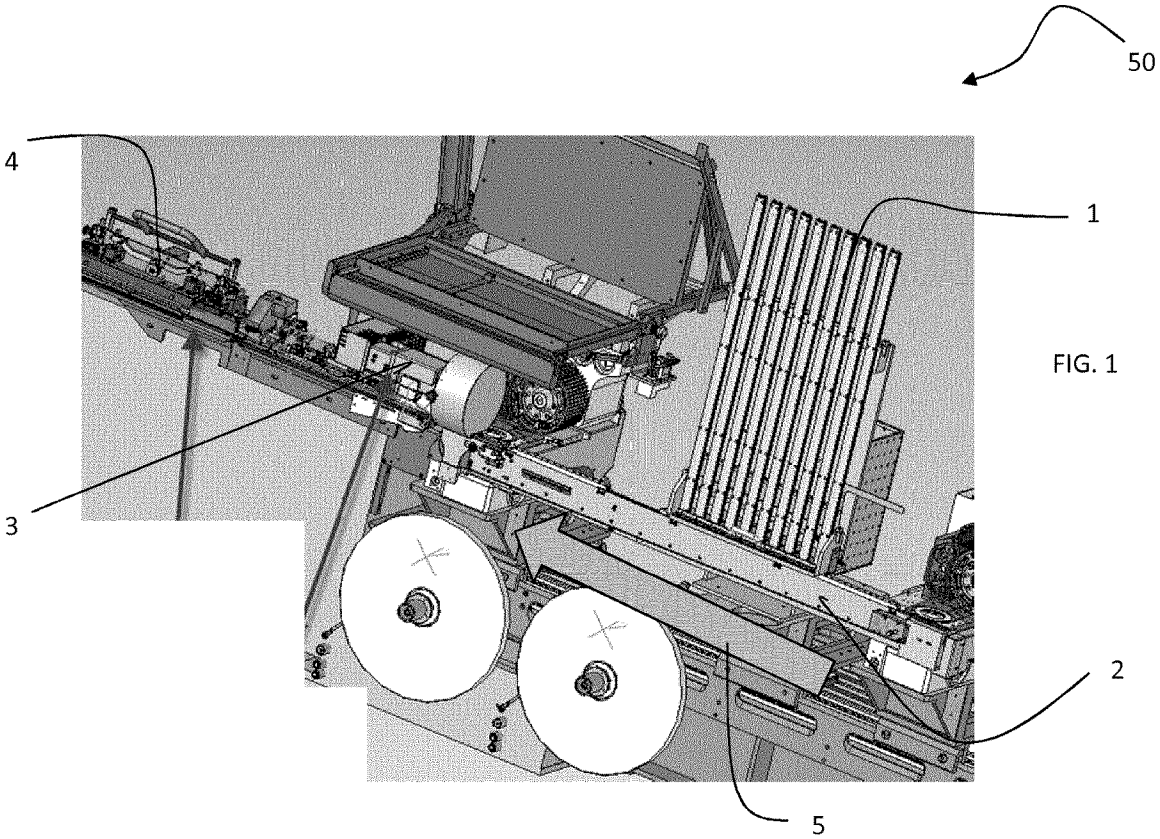
FIG. 1 is a schematic perspective view of an apparatus for manufacturing multi-component aerosol forming articles according to the present invention.

With reference to FIG. 1, an apparatus utilised to manufacture multi-component aerosol forming articles 20 is globally indicated with 50.

Figure 9:
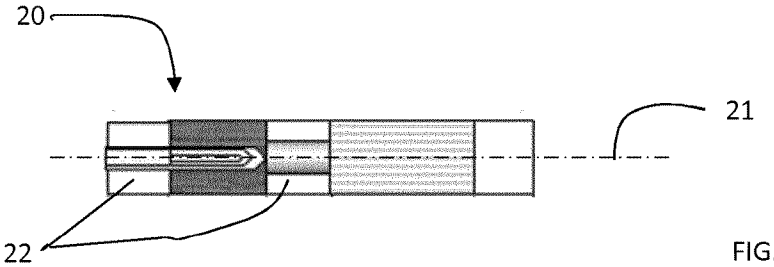
FIG. 9 is a schematic lateral view in section of an embodiment of a multi-component filter for an aerosol-forming device realized by the apparatus of FIG. 1.

An embodiment of a multi-component article 20, which can be realized using the apparatus 50 of FIG. 1, is schematically depicted in FIG. 9, where the article 20 includes five different components 22, that is, five components of different types, having different lengths along a common longitudinal axis 21. Each component 22 includes a tubular element and defines a longitudinal length along the longitudinal axis 21. The five components may be (from right to left) for example a mouthpiece plug, a PLA, a hollow component, a tobacco plug and a diffuser, however any other component can be used as well. Apparatus 50 may realize not only complete aerosol-forming articles and but also part thereof, such as multi-component filters.

The apparatus 50 includes at least a feeder 1, preferably two feeders (the second feeder is not shown in the drawings), a spacer drum 3 and a wrapping unit 4 where the different components 22 transported in a transport device 2 are wrapped, for example in a wrapping paper (not shown). The feeder 1, spacer drum 3 and wrapping unit 4 are located in series one after the other along a transport direction 5 (depicted with an arrow in FIG. 1) defined by the movement of the transport device 2.

Figure 2:
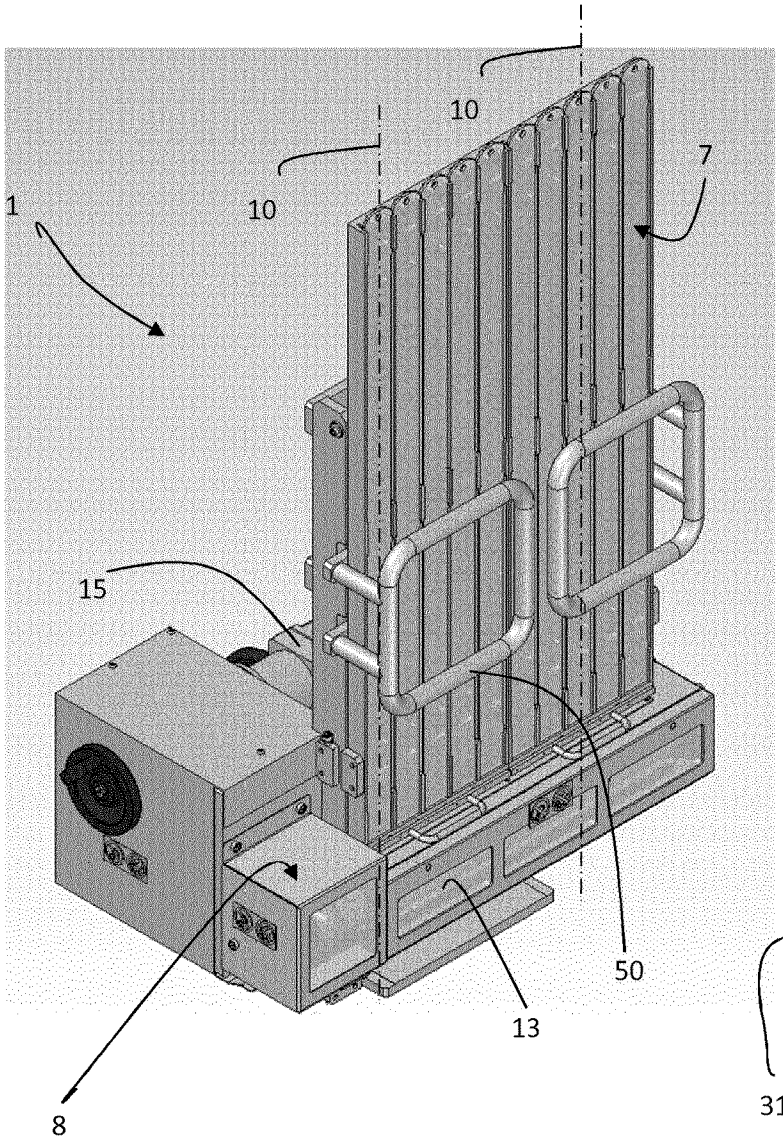
FIG. 2 is a perspective view of a feeder realized according to the invention, part of the apparatus of FIG. 1.
Figure 4:
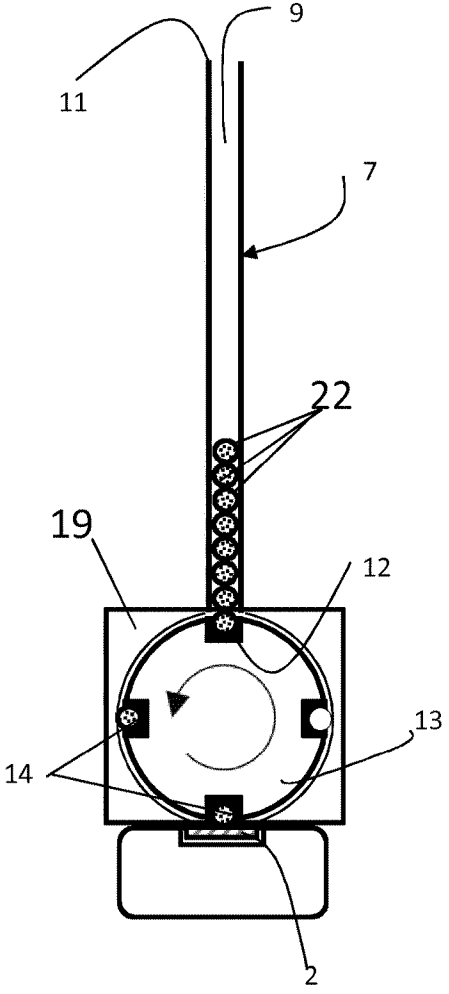
FIG. 4 is a schematic lateral view of the feeder of FIG. 2 and FIG. 3.
Figure 3:
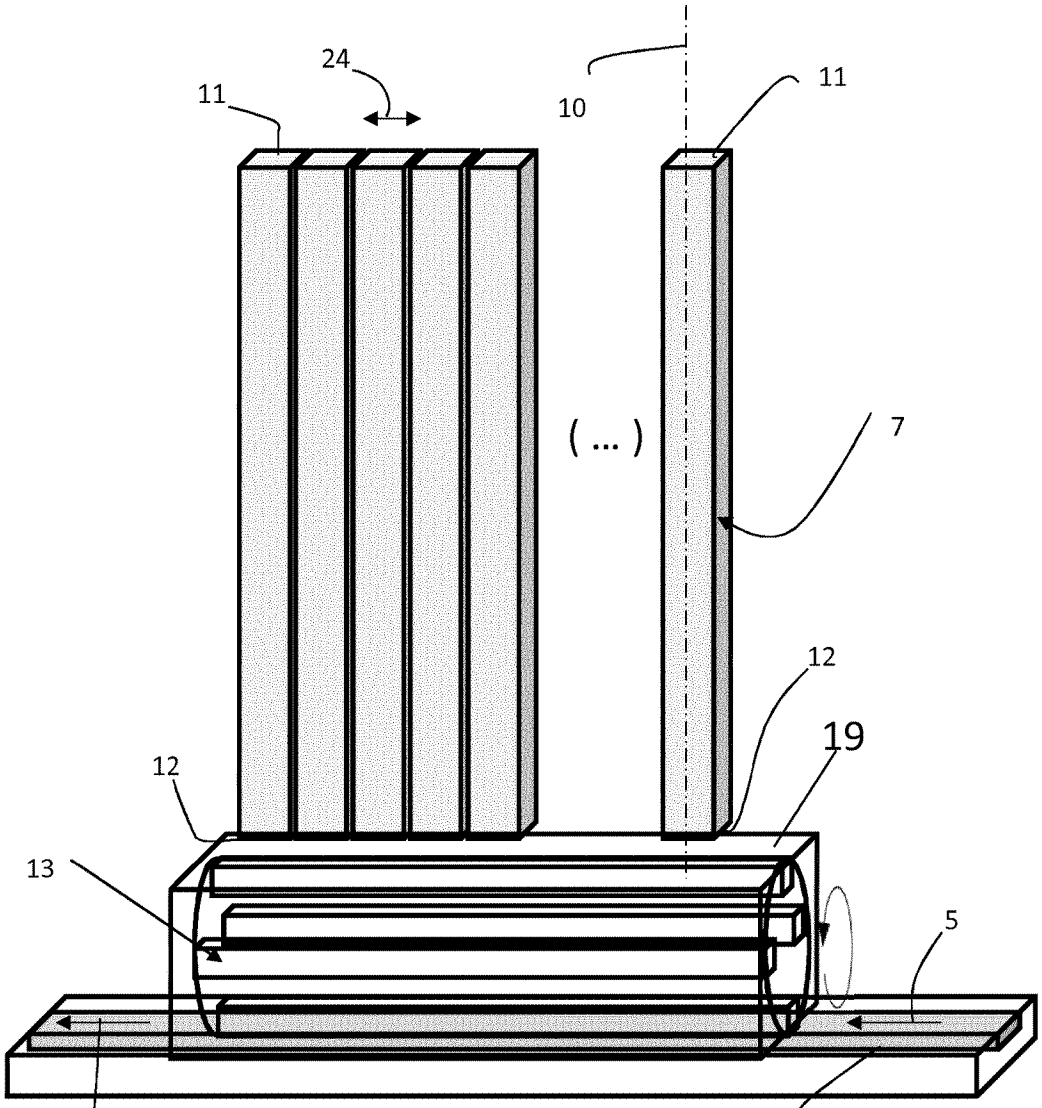
FIG. 3 is a schematic perspective view of the feeder of FIG. 2.

The feeder 1, with now reference to FIGS. 2-4, includes a plurality of hoppers 7. Hoppers 7 are all releasably attached to a frame 8 and are arranged substantially parallel to each other in a vertical direction. Each hopper 7 defines an inner channel 9 having an axis 10, which is preferably parallel to the vertical direction. The inner channel 9 includes an inlet 11 where the components 22 may be introduced and an outlet 12 for the delivery of components. The channels 9 have preferably a constant cross section along their axis 10, that is, in each channel 9 planes parallel to the axis 10 create cross-sections having the same dimensions.

Preferably, the feeder 1 includes a handle 50 for being easily transported.

Figure 7:
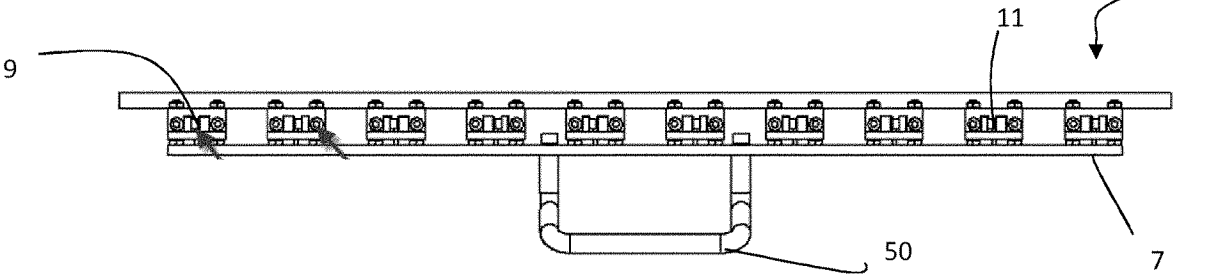
FIG. 7 is a partial top view of the feeder of FIG. 2 and FIG. 3.

Further, preferably the hoppers 7 of the plurality are arranged on the frame 8 so that they are aligned to each other. In this way, all channels 9 can be delimited by two parallel planes parallel to the channels' axes 10. Each hopper 7 thus is preferably positioned as a translation of the subsequent or precedent hopper along the transport direction 5 defined by the transport device 2. The inlets 11 and the outlets 12 of the hoppers 7 are therefore all aligned along the transport direction 5. This configuration cane be better seen in FIG. 7.

The feeder 1 further comprises a delivery drum 13 including a plurality of grooves 14 to house the components 22. The grooves 14 are also preferably aligned along the transport direction 5, that is, the grooves 14 and the transport direction 5 are preferably parallel to each other. The number of grooves 14 is arbitrary and they are preferably spaced apart at regular intervals.

The drum 13 is positioned below the hoppers 7 and above the transport device 2, so that the components 22 exiting the hoppers fall into one of the grooves 14. The grooves 14 are preferably at least as long as the total length of all the aligned outlets 12 of the hoppers, that is, at least as long as the distance between the first and the last outlet, which are aligned as mentioned above, of the feeder 1.

The transport device 2 preferably runs below the drum 13 and more preferably below the lowermost portion of the drum.

Figure 6:
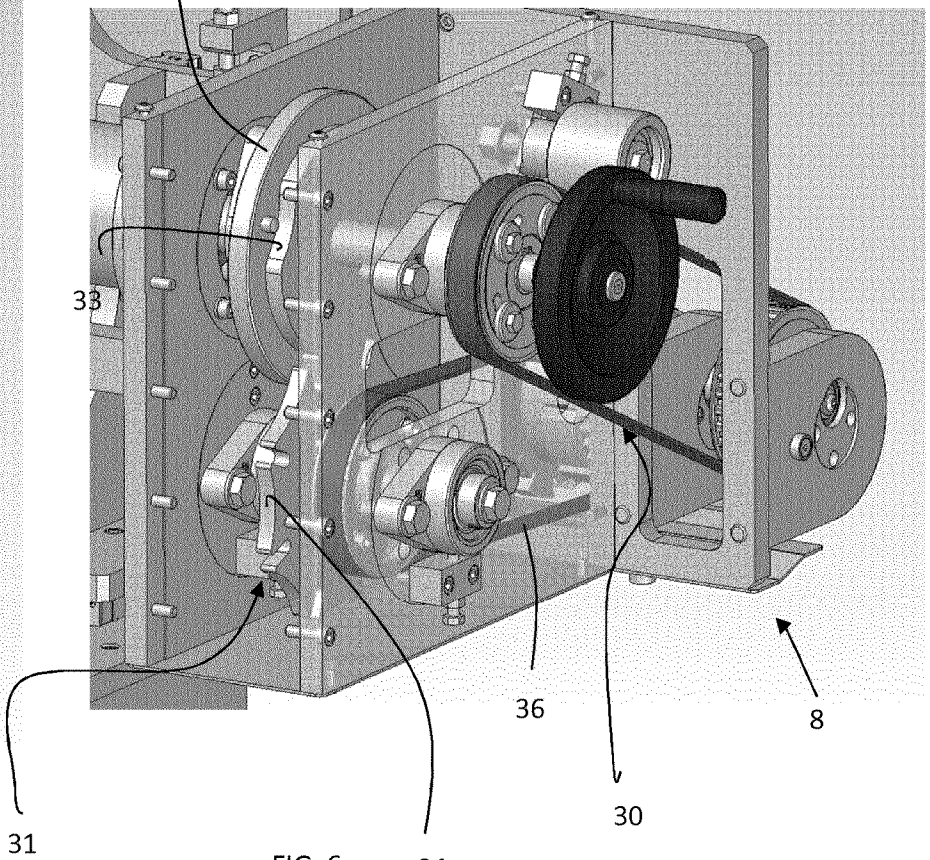
FIG. 6 is a perspective view in an enlarged scale of a part of the portion of the feeder of FIG. 5.
Figure 5:
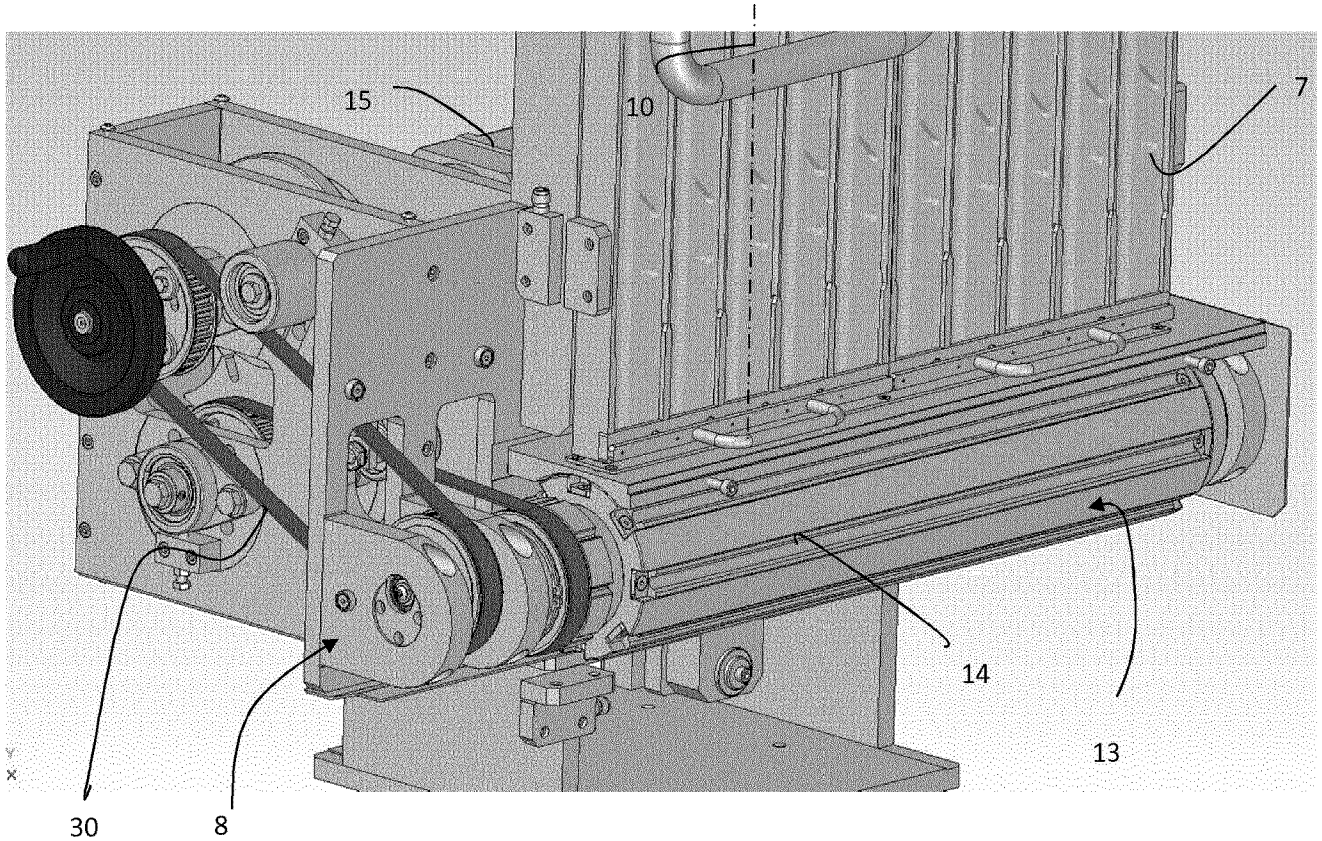
FIG. 5 is a perspective view in an enlarged scale of a portion of the feeder of FIGS. 2 and 3.

The delivery drum 13 is rotatable and the rotation is imparted by a motor 15 (see FIGS. 5 and 6), preferably housed in frame 8. The rotation mechanism from the motor to the drums includes two transmissions. A first transmission 30 couples the motor rotation to the drum 13. A second transmission 31 includes a Geneva drive. The second transmission 31 includes a transmission wheel 32 connected to the motor 15 including a notch 33. The second transmission 31 further includes a driven wheel 34 having a Maltese cross shape which is connected to the drum 13, for example via a belt 36. As known, the continuous motion of the transmission wheel 32 gives rise to a "step-motion" of the driven wheel 34. Preferably the step motion has an angular spacing which coincides with the angular spacing of the grooves 14 in the drum 13. Preferably, the axis of rotation of the delivery drum 13 is parallel to the transport direction 5. The rotation and the "step-wise motion" of the drum 13 causes the fall of the components 22 located in one of the groove 14 due to gravity onto the surface of the transport device 2.

Preferably, in order to avoid the exit of the components 22 from the grooves 14 before the groove is located above the transport device 2, one or more curvilinear walls 19 is located in the vicinity of the drum 13. The wall 19 follows the contour of at least a portion of the outer surface of the drum 13, so that the components 22 are sandwiched between the outer surface of the groove 14 and the surface of the wall 19. The wall 19 can include for example two symmetrically arranged portions at two sides of the drum 13, as shown in FIG. 4. In order to allow the rotation of the drum 13, there is no contact between the surface of the drum 13 and the wall 19, but preferably a gap of relatively small dimension is formed between the wall 19 and the drum 13. Preferably, the diameter of the groove 14 is slightly larger than the diameter of the components, for example about 0.5 millimeters larger.

The transport device 2 preferably includes a belt and a suction device (not shown in the drawings). The suction device is adapted to suck air from holes (also not shown) realized on the transport device. The components 22 positioned on the transport device 2 are therefore pulled towards the transport device itself by the sucking action and they are kept in place, minimizing the loss of components during the transport along apparatus 50.

Figure 8:
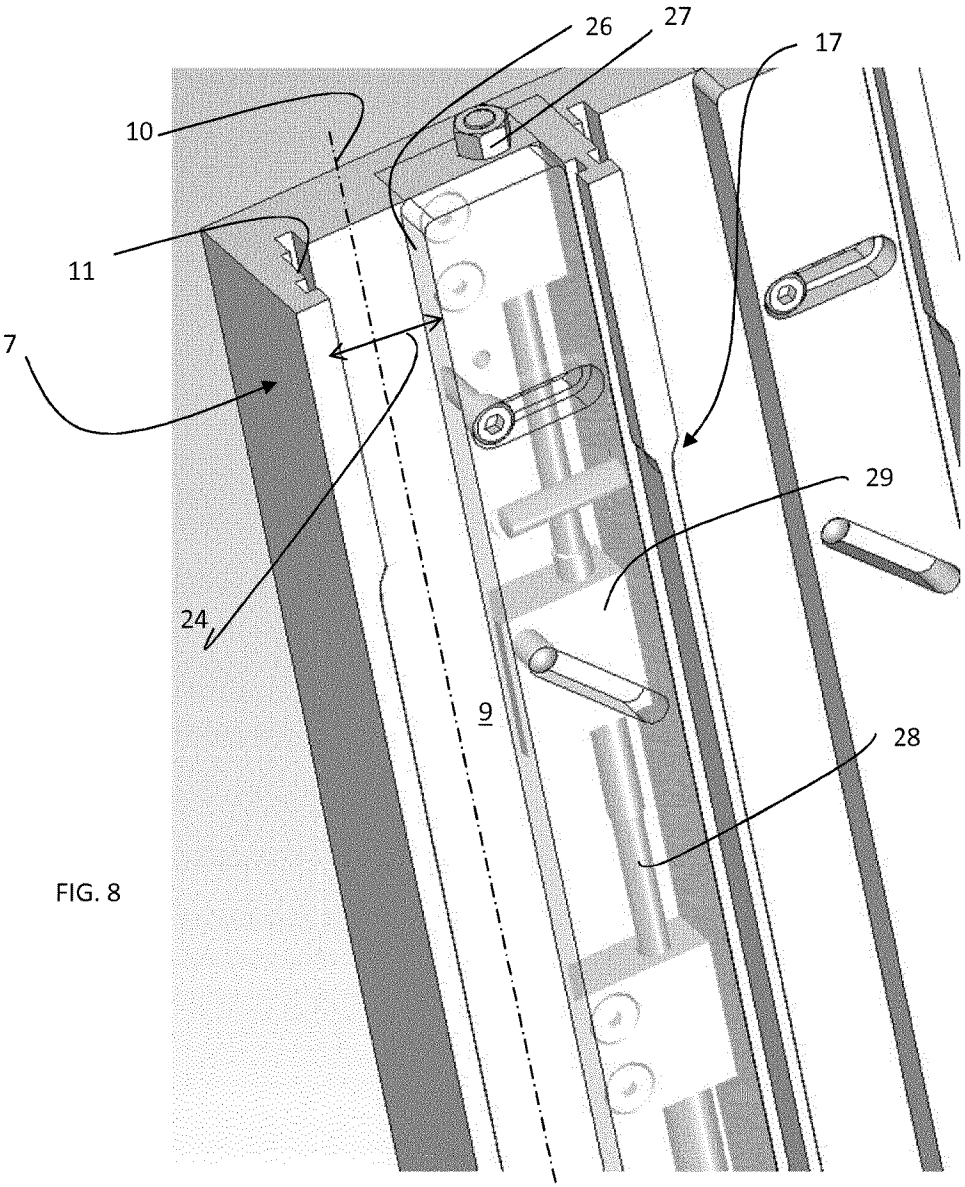
FIG. 8 is a partially sectioned view of a portion of the feeder of FIG. 2 and FIG. 3.

Further, at least one hopper 7, and more preferably all hoppers 7 of the plurality in the feeder 1, includes a size change device 17, represented in FIG. 8. The size change device 17 allows to change the dimension of the cross section of the inner channel 9 of the hopper. Preferably, each hopper includes a size change device in order to change its cross section. Preferably, the cross section is changed along the transport direction 5, that is, the size of the channel 9 along the direction along which the hoppers 7 are aligned, can be increased or reduced by the transport device. The dimension of the channel 9 along the transport direction is called in this preferred embodiment insert dimension, being the dimension along which the components are inserted. The components are inserted into the channel 9 with their length parallel to the insert dimension 24. Therefore, insert dimension 24 of the channel 9 can be continuously changed. Preferably, if the component 22 has a length along its longitudinal axis of about 5 millimeters, the insert dimension of the channels is of about 6 millimeters, that is, the insert dimension is slightly longer than the length of the component 22 which is inserted.

The size change device 17 includes a slidable or movable wall 26. The movable wall 26 is one of the walls of the channel, that is, it is an internal wall of the channel 9. The wall 26 is slidable operating on a nut or bolt 27 which in turn rotates a screw 28 which extends parallel to the axis of the channel along its length. By a known mechanism 29, the rotational movement due to the screw 28 is transformed into a translational movement which, acting on wall 26, makes it moves, changing the size of the insert dimension 24.

The apparatus 50 operates as follows.

Hoppers 7 are filled with components 22. Preferably, the filling is performed while the hoppers are detached from frame 8. In order to avoid that components 22 drop from the outlet 12 of the hopper 7 while transported, preferably a cover is used (not shown in the drawings) to cover the outlet and avoid the exit of components. The components 22 in a single hopper 7 of feeder 1 are preferably all identical one to the other. However, among two hoppers in the same feeder 1, the components can be the same or different. The insert dimension 24 of the cross section of each channel 9 is selected depending on the size of the components, and in particular preferably depending on their longitudinal length along the longitudinal axis 21, adjusting the size changing device 17 accordingly. Acting on the nut 27, the position of wall 26 can be selected. If the components 22 are different in the various hoppers 7, preferably different cross-section insert dimensions 24 can be selected as well, a different cross section of the channel 9 for each hopper 7, regulating the corresponding size change device 17 accordingly.

Preferably the insert dimension 24 of channel 9 is slightly longer than the longitudinal length of the component 22, which is then inserted with its longitudinal axis 21 aligned to the transport direction 5. The channel 9 is preferably shaped so that the insert dimension 24 is the biggest insertion size at the inlet 11, that is, the insert dimension 24 allows insertion of the component and at the same time all the other dimensions of the cross section of the channel are smaller than it (there could be some longer dimensions, but they do not allow the insertion of a component).

The components 22 within the channels 9 cannot rotate or may rotate in an angularly restricted manner, due to the fact that generally the longitudinal direction of the components is the longest direction in the component, therefore the dimensions of the cross section of the channel hinder rotation of the component. The components 22 therefore exit the hoppers 7 from outlets 12, preferably by the sole action of gravity, and fell onto the groove 14 of the delivery drum 13, with the same orientation they had at the inlet 11. The drum 13 then rotates by the activation of motor 15 and delivers the components 22 to the transport device 2. The transport device 2 transports the components 22 along the transport direction 5. The transport device 2 may for example transport the components 22 towards other feeders, that is, below other feeders, which can be similar or different to the feeder 1 above described.

The other feeders may deliver onto the transport device 2 components which are the same or different than the components delivered by the feeder 1. Further, downstream the feeder or the feeders in the transport direction 5, preferably the transport device 2 transports the components 22 towards the spacer drum 3 which reduces the gap present among adjacent components and then towards the wrapping unit 4 where the components 22 are wrapped in a wrapping paper. The components so wrapped are then preferably cut so as to form the article 20 as depicted in FIG. 9.

More than one cutting element can be present.

The invention claimed is:

1. Feeder for components of an aerosol-forming article, the feeder comprising:

a plurality of tubular hoppers, each hopper being adapted to receive and to deliver a plurality of components, each hopper including an inlet and an outlet and a channel connecting the inlet and the outlet, each channel having an axis and defining an insert dimension in a direction perpendicular to the axis, the insert dimension being constant along the axis of the channel;

a frame to which the tubular hoppers are fastened and arranged so that their axes are substantially parallel to each other and in series along a transport direction;

a delivery drum including a plurality of angularly spaced grooves arranged substantially parallel to said transport direction, said drum being located under the outlets of the tubular hoppers so that components going through said channels are delivered into one of said grooves;

a motor to rotate said delivery drum;

a transport device located under said delivery drum and adapted to transport said components delivered by the delivery drum along the transport direction; and a size change element adapted to vary the insert dimension of the channel of at least one of the plurality of hoppers.

2. The feeder according to claim 1, wherein each hopper of said plurality is releasably fastened to said frame.

3. The feeder according to claim 1, wherein said hoppers are arranged so that said axes of the channels are substantially parallel to a vertical direction so that components inserted into the channels via the inlet fall toward the outlet due to gravity.

4. The feeder according to claim 1, wherein said insert dimension defines a major dimension of said inlet or of said outlet in which an insertion of said component is possible.

5. The feeder according to claim 1, wherein said insert dimension is a dimension of said channel along the transport direction.

6. The feeder according to claim 1, wherein the channel has a constant cross section along planes perpendicular to its axis.

7. The feeder according to claim 6, wherein a size of the cross section is such that the insertion of a single component is possible, so that the channel is adapted to house a single column of components.

8. The feeder according to claim 1, including a suction device and wherein said transport device includes a plurality of holes, said suction device being adapted to suck air from said holes so as to keep the components connected to the transport device.

9. The feeder according to claim 1, including one or more curvilinear wall contouring without contact at least a portion of a lateral surface of the delivery drum.

10. The feeder according to claim 1, wherein each hopper of the plurality includes a size change element.

11. The feeder according to claim 10, wherein the each size change element of the plurality of size change elements is independently adjustable.

12. The feeder according to claim 1, including a handle.

13. The feeder according to claim 1, including a cover for the outlet of at least one hopper when the hopper is detached from the frame.

14. The feeder according to claim 1, wherein said size change element includes a slidable wall which is adapted to be slidable along a direction defined by said insert dimension.

15. The feeder according to claim 14, wherein said slidable wall is movable by a screw.

16. The feeder according to claim 1, including at least 5 hoppers.

17. An apparatus for the realization of a multi-component aerosol-forming article, comprising one or more feeders according to claim 1.

18. The apparatus according to claim 17, comprising a first feeder and a second feeder, the second feeder being apt to feed components to the same transport device as the first feeder.

19. The apparatus according to claim 17, further including a spacer drum located downstream of said feeder.

20. The apparatus according to claim 17 comprising a wrapping station so as to wrap the components fed by said feeder.

* * * * *